US009289671B2

(12) United States Patent
Heddleston

(10) Patent No.: US 9,289,671 B2
(45) Date of Patent: Mar. 22, 2016

(54) GOLF SWING INSTRUCTION DEVICE AND METHOD OF USE THEREOF

(71) Applicant: HGH Enterprises, LLC, Scottsdale, AZ (US)

(72) Inventor: Eric Heddleston, Chandler, AZ (US)

(73) Assignee: HGH ENTERPRISES, LLC, Scottsdale, AZ (US)

( * ) Notice: Subject to any disclaimer, the term of this patent is extended or adjusted under 35 U.S.C. 154(b) by 0 days.

(21) Appl. No.: 14/027,194

(22) Filed: Sep. 14, 2013

(65) Prior Publication Data

US 2014/0080619 A1 Mar. 20, 2014

Related U.S. Application Data

(60) Provisional application No. 61/701,280, filed on Sep. 14, 2012.

(51) Int. Cl.
*A63B 69/36* (2006.01)
*A63B 71/06* (2006.01)

(52) U.S. Cl.
CPC ..... *A63B 69/3667* (2013.01); *A63B 69/3623* (2013.01); *A63B 69/3676* (2013.01); *A63B 2071/0694* (2013.01); *A63B 2210/50* (2013.01); *A63B 2225/09* (2013.01)

(58) Field of Classification Search
USPC ..... 473/218, 219, 231, 257, 261, 262, 265, 473/266, 270, 272, 273, 278, 279, 409, 422, 473/434, 450, 452, 457
See application file for complete search history.

(56) References Cited

U.S. PATENT DOCUMENTS

| | | | | |
|---|---|---|---|---|
| 5,246,234 | A * | 9/1993 | Zambelli | 473/272 |
| 5,350,177 | A * | 9/1994 | Furbush, Jr. | 473/218 |
| 5,411,266 | A * | 5/1995 | Guthry | 473/218 |
| 5,464,220 | A * | 11/1995 | Hansen et al. | 473/218 |
| 7,922,598 | B1 * | 4/2011 | Karpyak et al. | 473/272 |
| 8,100,778 | B2 * | 1/2012 | Willis | 473/218 |
| 2008/0015046 | A1 * | 1/2008 | Baggott | 473/272 |

* cited by examiner

*Primary Examiner* — Nini Legesse
(74) *Attorney, Agent, or Firm* — Schmeiser, Olsen & Watts LLP

(57) ABSTRACT

A golf swing instruction device is provided that includes first and second members, each being moveable with respect to one another by way of coupling arms coupled there between. Positioning members, for a golfer's feet and the golf ball, may be moved along a length of the first and second members to help position the golfer with respect to the ball. The first and second members may be positioned next to one another, may be moved away from each other on a first end or on an opposing second end, or may be moved away from one another on both ends such that first and second members are spaced apart from one another. In these configurations, the device assists the golfer in shaping a golf shot, such as a straight shot, fade, draw or putt.

7 Claims, 8 Drawing Sheets

GOLF SWING INSTRUCTION DEVICE AND METHOD OF USE THEREOF

CROSS REFERENCE TO RELATED APPLICATION[S]

This application claims priority to U.S. Provisional Patent Application to Heddleston entitled "GOLF SWING INSTRUCTION DEVICE AND METHOD OF USE THEREOF," Ser. No. 61/701,280, filed Sep. 14, 2013, the disclosure of which is hereby incorporated entirely herein by reference.

BACKGROUND

1. Technical Field

This disclosure relates generally to golf swing training aids, and in particular to a device used to instruct a golfer how to position his/her body relative to the golf ball to properly address the ball to perform a proper swing to create the desired effect on the golf ball's flight.

2. State of the Art

The positioning of a golfer's body relative to the golf ball and during the golfer's swing impacts the accuracy and distance of the resulting flight of the golf ball. Ideally, in addressing the golf ball prior to the golf swing, the golfer should assume a stance that positions his/her feet relative to the golf ball such that the feet are about shoulder width apart and the toes of the feet create an imaginary line parallel with the target line, which is the line between the ball and the intended target.

Moreover, the golfer's stance should position the ball between the feet so that a straight line between the golfer and the golf ball is perpendicular to the imaginary line established by the feet, with the perpendicular straight line passing slightly to the target side of the golf ball, depending on the golf club selected, but inside the target-side foot of the golfer. Such a stance results in the golfer's body, and in particular the golfer's feet, hips and shoulders, being aligned parallel to the imaginary line to maximize the probability that the golfer effectuates an accurate shot.

In addition to the golfer's body position, the positioning of the face of the head of the golf club relative to the golf ball significantly impacts the accuracy of the golf shot. To perform a straight shot, the golf club face should be "square" to the ball. That is, to provide the best chance that the golf ball takes a straight line of flight to the intended target, the golf club face should be perpendicular to the target line at the point of impact between the club face and the ball.

Oftentimes, a golfer who is working on his/her swing to improve accuracy will lay a club on the ground on a line parallel to the target line as a guide for foot alignment before taking a practice shot. The golfer aligns the shaft of the club parallel to the target line and thereafter places his/her toes against the shaft. By placing the toes of each foot against the club that is aligned parallel with the target line, the golfer's body should be properly positioned relative to the golf ball. Thereafter, the golfer's swing should result in straight flight path of the ball toward the target.

However, while the above-described technique might crudely assist in proper foot alignment, it does not help in proper ball positioning or club face squaring, each of which affects the flight of the golf ball. Indeed, laying a club at the golfer's feet provides little assistance to the golfer who wishes to shape a golf shot, because lining up one's feet is only one variable in a number of variables that affect the flight of a golf ball and the accuracy of the golf shot. Other conventional golf swing training devices may attempt to address these other variables, but oftentimes these devices are too bulky to fit within the golfer's golf bag.

Thus, there is a need in the golf market for a portable device that addresses the concerns raised above. There is a need for a portable golf swing training device that properly aligns the golfer's body relative to the golf ball and assists the golfer in shaping the desired golf shot.

SUMMARY

The present invention relates to a device used to instruct a golfer how to position his/her body relative to the golf ball to properly address the ball to perform a proper swing to create the desired effect on the golf ball's flight.

An aspect of the present disclosure includes a golf swing training device comprising a first member having a first end and a second end, a second member having a first end and a second end, an adjustable coupling arm functionally coupling the first member to the second member, wherein the coupling arm is configured to permit the first and second members to transition with respect to one another to increase or decrease a distance between at least a portion of first and second members, and a positioning member configured on each of the first member and the second member, the positioning members being configured to transition along a length of the first and second members, respectively, wherein at least one of the positioning members is configured to change length.

Another aspect of the present disclosure includes wherein the adjustable coupling arm further comprises two coupling arms, a first coupling arm pivotally coupled to the first member, a second coupling arm pivotally coupled to the second member, and the first and second coupling arms pivotally coupled to one another.

Another aspect of the present disclosure includes wherein the coupling arms are configured to permit the first end of the first member and the first end of the second member to transition away from one another while permitting the second end of the first member and the second end of the second member to remain proximate one another, and wherein the coupling arms are configured to permit the second end of the first member and the second end of the second member to transition away from one another while permitting the first end of the first member and the first end of the second member to remain proximate one another.

Another aspect of the present disclosure includes wherein the positioning members are configured to pivot with respect to the corresponding first or second member between an orthogonal position, wherein the positioning member is orthogonal to the length of the corresponding first or second member, and a parallel position, wherein the positioning member is parallel to the length of the corresponding first or second member.

Another aspect of the present disclosure includes wherein two positioning members are configured on the first member and a third positioning member is configured on the second member, wherein each of the three positioning members are configured to pivot with respect to the respective first and second members, and the third positioning member is configured to change length.

Another aspect of the present disclosure includes end caps configured to be inserted on each of the first and second ends of the first and second members.

Another aspect of the present disclosure includes wherein the end caps comprise a cable post about which a cable is looped on the first member, the cable running along the length of the first member in an interior opening thereof.

Another aspect of the present disclosure includes wherein two positioning members are configured on the first member, and wherein the two positioning members on the first member are coupled to opposing sides of the looped cable and configured to transition with respect to one another in opposite directions along the length of the first member based on the relative movement of one of the two positioning members with the cable.

Another aspect of the present disclosure includes a golf swing training device, the device comprising a first member having a length defined between a first end and a second end, a second member having a length defined between first end and a second end, and pairs of coupling arms, each pair coupling the first member to the second member, wherein the pairs of coupling arms are configured to permit the first and second members to transition with respect to one another between a closed position wherein the first and second members are proximate one another along their respective lengths, a pivoted position wherein the first and second members are angled with respect to one another, and an open position wherein the first and second members are spaced apart from one another and substantially parallel with one another.

Another aspect of the present disclosure includes wherein in the pivoted position the coupling arms are configured to permit the first end of the first member and the first end of the second member to transition away from one another while permitting the second end of the first member and the second end of the second member to remain proximate one another.

Another aspect of the present disclosure includes wherein in the pivoted position the coupling arms are configured to permit the second end of the first member and the second end of the second member to transition away from one another while permitting the first end of the first member and the first end of the second member to remain proximate one another.

Another aspect of the present disclosure includes two positioning members configured on the first member and a third positioning member on the second member, each of the three positioning members being configured to transition along a length of the first and second members, respectively.

Another aspect of the present disclosure includes wherein the positioning members on the first member position a golfer's feet relative to a golf ball that is positioned according to the position of the third positioning member on the second member.

Another aspect of the present disclosure includes wherein in the pivoted position the device is positioned on a surface and the second member is aligned parallel with a target line between the golf ball and an intended target and the first member is angled with respect to the second member to a degree of movement desired of a golf ball during flight.

Another aspect of the present disclosure includes wherein in the closed and pivoted positions a golf ball is positioned on an opposite side of the device to that of a golfer, and wherein in the open position the golf ball is positioned in between the first and second members.

Another aspect of the present disclosure includes A method of using a golf swing training device, the method comprising providing a golf swing training device having a first member and a second member, positioning the golf swing training member on a ground surface such that the second member is parallel with a target line between a golf ball and an intended target, placing a golf ball on the ground surface according to positioning determined by the second member, addressing the golf ball by placing feet according to positioning determined by the first member, squaring the face of a golf club with the golf ball, such that the face of the golf club is perpendicular to the target line, and swinging the golf club to make contact with the golf ball.

Another aspect of the present disclosure includes wherein addressing the golf ball further comprises positioning feet between positioning members moveable along a length of the first member.

Another aspect of the present disclosure includes wherein the positioning members may be spaced apart by shoulder width of a golfer.

Another aspect of the present disclosure includes pivoting the first member apart from the second member at a first end or at a second end, such that the first member is angled with respect to the second member.

Another aspect of the present disclosure includes swinging the golf club in a path parallel with the length of the first member.

The foregoing and other features, advantages, and construction of the present disclosure will be more readily apparent and fully appreciated from the following more detailed description of the particular embodiments, taken in conjunction with the accompanying drawings.

BRIEF DESCRIPTION OF THE DRAWINGS

Some of the embodiments will be described in detail, with reference to the following figures, wherein like designations denote like members.

DETAILED DESCRIPTION OF EMBODIMENTS

A detailed description of the hereinafter described embodiments of the disclosed apparatus and method are presented herein by way of exemplification and not limitation with reference to the Figures listed above. Although certain embodiments are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of embodiments of the present disclosure.

As a preface to the detailed description, it should be noted that, as used in this specification and the appended claims, the singular forms "a", "an" and "the" include plural referents, unless the context clearly dictates otherwise.

Figure 1:
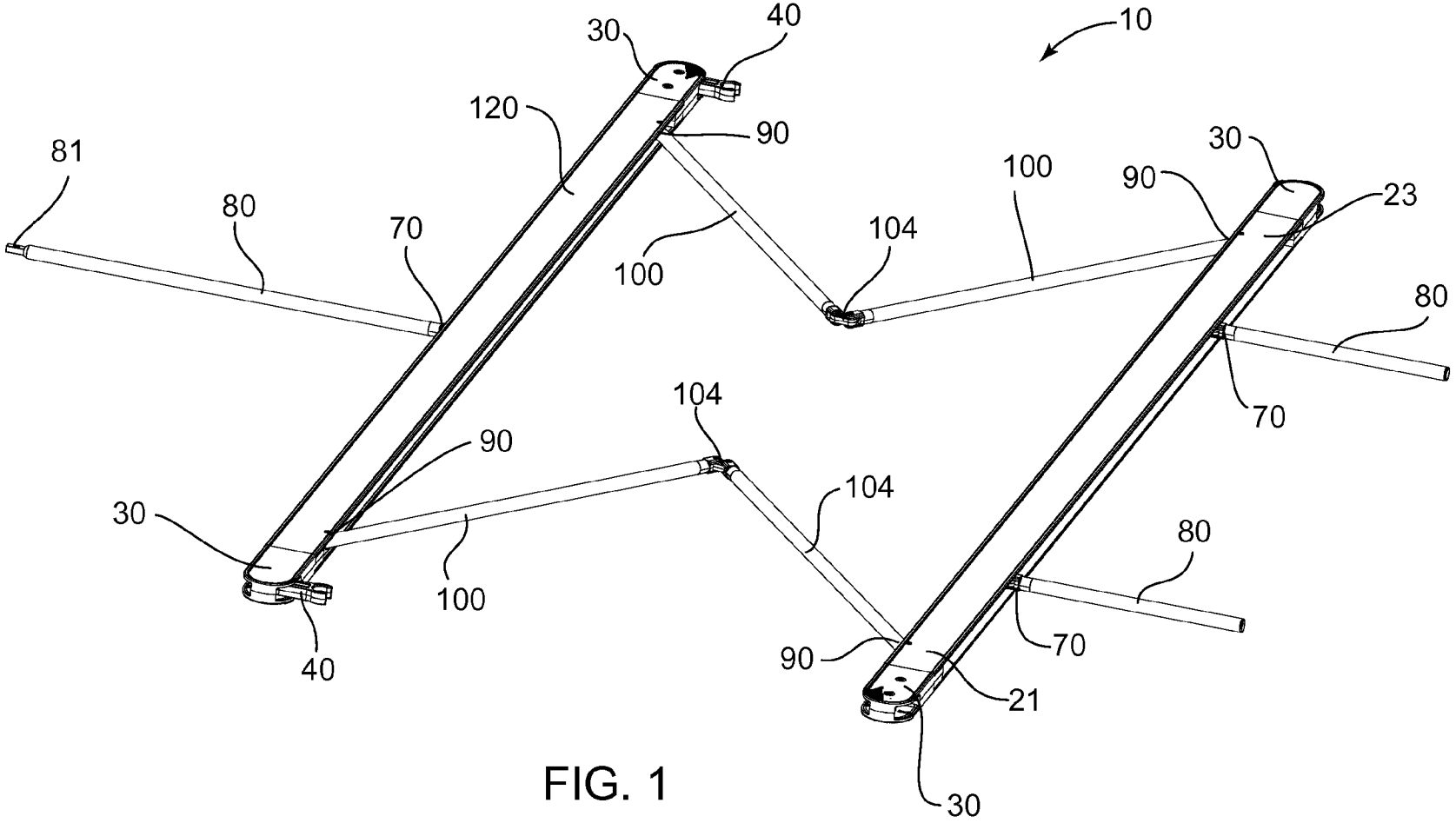
FIG. 1 is a perspective view of an embodiment of a golf swing training device in accordance with the present disclosure.
Figure 2:
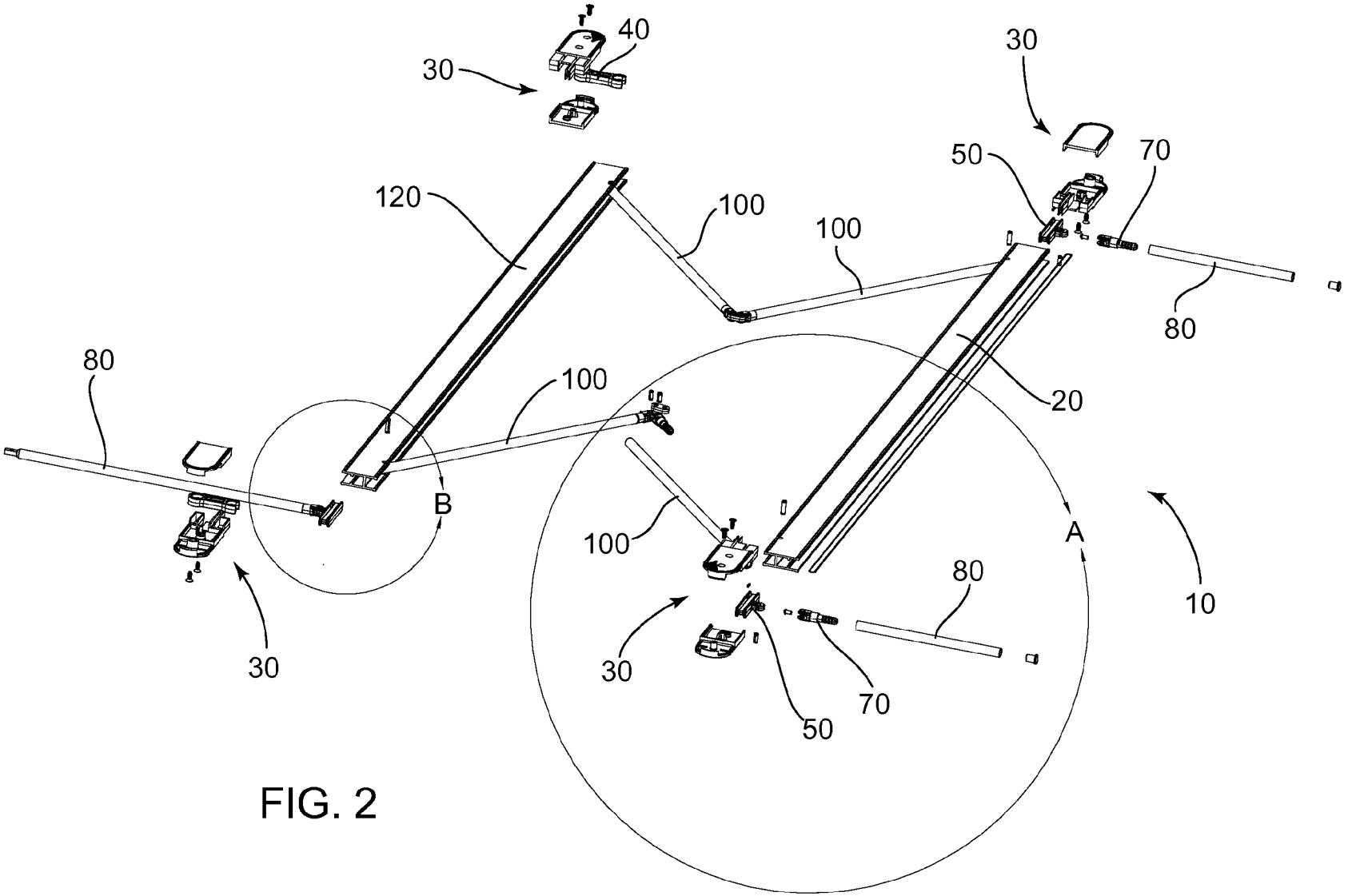
FIG. 2 is an exploded perspective view of an embodiment of the golf swing training device in accordance with the present disclosure.
Figure 3:
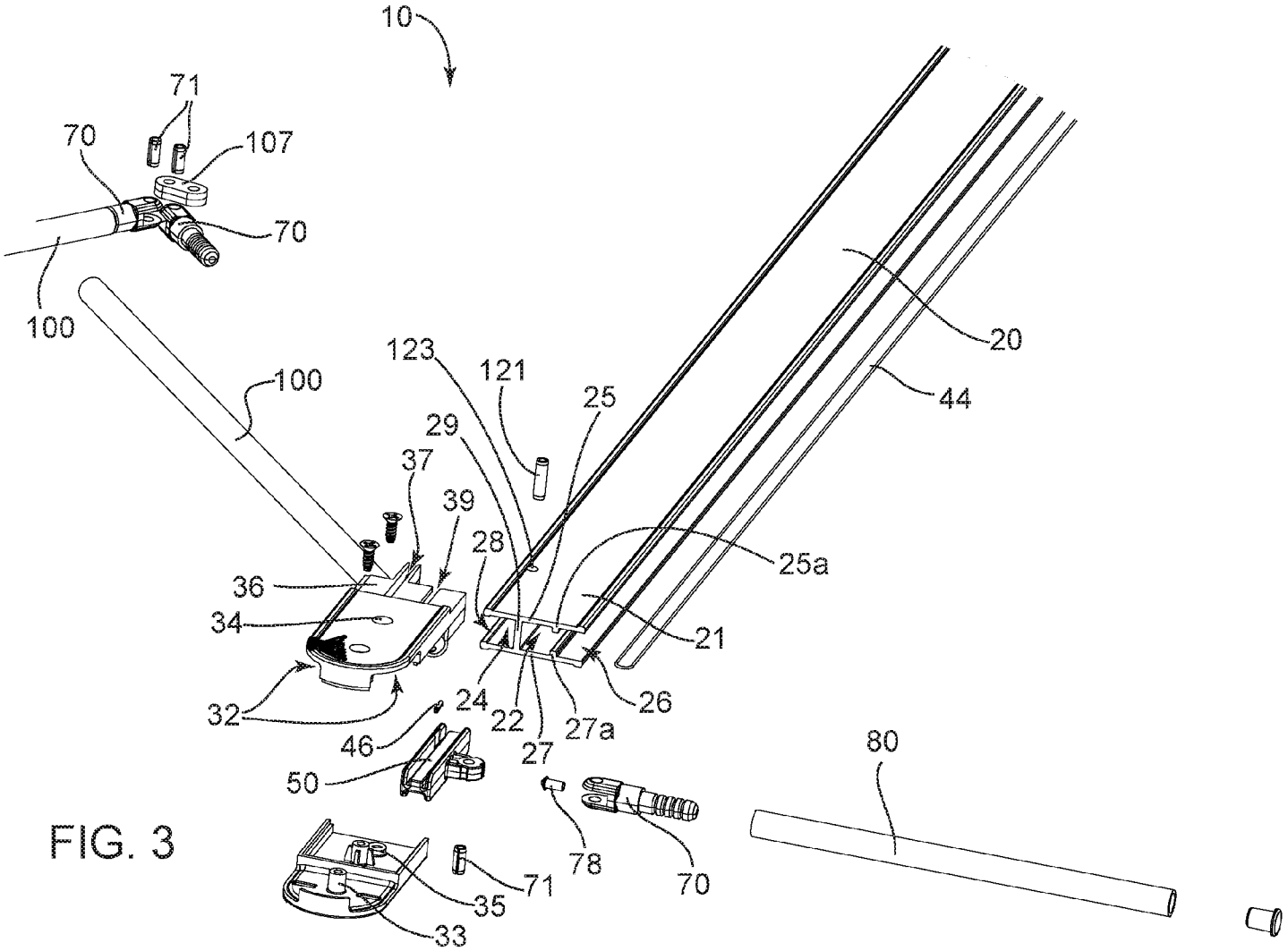
FIG. 3 is a partial exploded perspective view of an embodiment of the components of circle A of FIG. 2 of the golf swing training device in accordance with the present disclosure.
Figure 4:
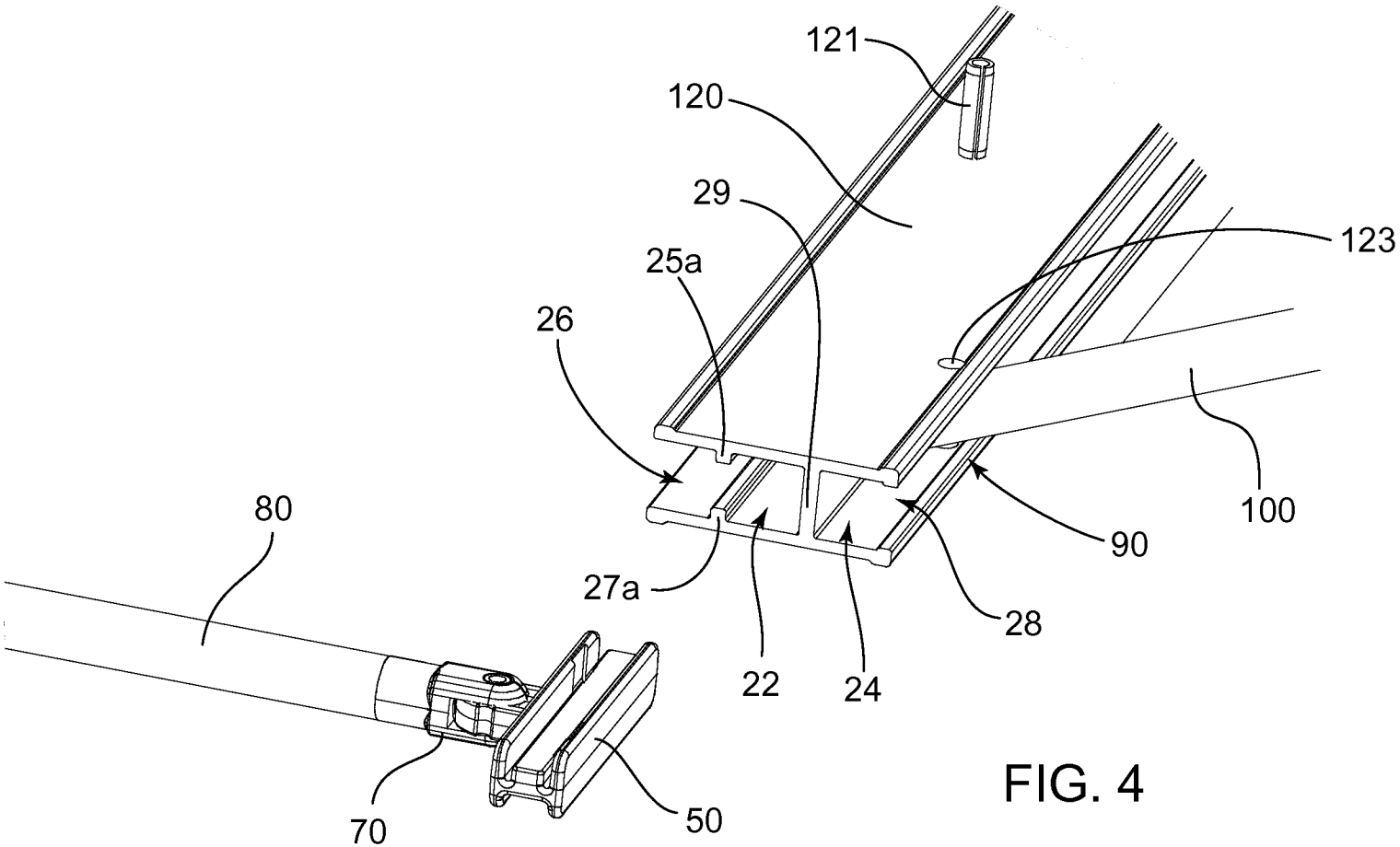
FIG. 4 is a partial exploded perspective view of an embodiment of the components of circle B of FIG. 2 of the golf swing training device in accordance with the present disclosure.

Referring to the drawings, FIG. 1 depicts a golf swing training device 10. Embodiments of the device 10 comprise various structural components that complement one another to provide the unique functionality and performance of the device 10, the structure and function of which will be described in greater detail herein. Embodiments of the device 10 may comprise, among other components, a first member 20, a second member 120, coupling arms 100 that couple the first member 20 to the second member 120, pivot members 70, and positioning members 80 configured to be adjustable along the length of either first or second members 20 and 120.

Referring to FIGS. 1-5, embodiments of the device 10 may comprise a first member 20. The first member 20 may have a length defined between a first end 21 and a second end 23, the first and second ends 21 and 23 opposing one another. Embodiments of the first member 20 can include the cross-section being more or less in the shape of an I-beam. As such, the first member 20 may comprise a top surface 25 and a bottom surface 27 with an interior wall 29 positioned substantially orthogonally between the top and bottom surfaces 25 and 27. The interior wall 29 may divide the area between the top and bottom surfaces 25 and 27 into openings 22 and 24 that may run the entire length of the first member 20. The first member 20 may further comprise slits 26 and 28 running along the length of the first member 20 and positioned in a side edge thereof. The slits 26 and 28 may be defined more or less in the sidewalls, or a side edge, of the first member 20. The slits 26 and 28 may communicate with the openings 22 and 24, respectively, and the slits 26 and 28 may be open to ambient space, the benefit of which will be described herein. The opening 22 may further comprise tab 25*a* protruding from an interior of the top surface 25 into the opening 22 and tab 27*a* protruding from an interior of the bottom surface 25 into the opening 22. Tabs 25*a* and 27*a* may be configured to protrude in the direction of one another within the opening 22, such that tabs 25*a* and 27*a* may oppose one another. Further, tabs 25*a* and 27*a* may define the slit 26 therebetween. The first member 20 may be made of rigid materials, such as wood, metal, plastic, or other composite material that maintains its relative shape.

Embodiments of the device 10 may further comprise the second member 120. The second member 120 may be configured to have a structure that is similar to the first member 20, as has been described herein. The second member 120 may be comprised similarly to the first member 20 in that the second member 120 may likewise have a length defined between a first end 21 and a second end 23, the first and second ends 21 and 23 opposing one another. Embodiments of the second member 120 can include the cross-section being more or less in the shape of an I-beam. As such, the second member 120 may comprise a top surface 25 and a bottom surface 27 with an interior wall 29 positioned substantially orthogonally between the top and bottom surfaces 25 and 27. The interior wall 29 may divide the area between the top and bottom surfaces 25 and 27 into openings 22 and 24 that may run the entire length of the second member 120. The second member 120 may further comprise slits 26 and 28 running along the length of the second member 120 and positioned in a side edge thereof. The slits 26 and 28 may be defined more or less in the sidewalls, or a side edge, of the second member 120. The slits 26 and 28 may communicate with the openings 22 and 24, respectively, and the slits 26 and 28 may be open to ambient space, the benefit of which will be described herein. The opening 22 may further comprise tab 25*a* protruding from an interior of the top surface 25 into the opening 22 and tab 27*a* protruding from an interior of the bottom surface 25 into the opening 22. Tabs 25*a* and 27*a* may be configured to protrude in the direction of one another within the opening 22, such that tabs 25*a* and 27*a* may oppose one another. Further, tabs 25*a* and 27*a* may define the slit 26 therebetween. The second member 120 may be made of rigid materials, such as wood, metal, plastic, or other composite material that maintains its relative shape.

Embodiments of the device 10 may further comprise one or more end caps 30. An end cap 30 may be configured to functionally engage the first or second members 20 or 120 at one of the first end 21 and the second end 23, or both, such that an end cap 30 may be configured on and/or coupled to each of the first end 21 and the second end 23. The end caps 30 may be configured to further comprise one or more component pieces that may be configured to be coupled together to form the end cap 30. Regardless, the end cap 30 may comprise an aperture 32 defined by outer side walls of the end caps 30, such that the aperture 32 may receive therein and therethrough a securing member 40. The end caps 30 may further comprise a through bore 34 in a top surface thereof for receiving and/or engaging a fastener 31 therein. The fastener 31 may be configured to fixedly couple the component portions of the end cap 30 to one another to form the complete end cap 30.

As suggested above, the end cap 30 may be configured to couple to the first or second members 20 or 120. For example, the end caps 30 may comprise one or more protuberances 36 extending from the end cap 30 that may be configured to engage the openings 22 and/or 24 in the first and second ends 21 and 23 of the first or second members 20 or 120. The protuberances 36 may be configured to functionally engage the interior surfaces of openings 22 and 24 to functionally secure the end cap 30 to the first or second members 20 or 120. The protuberances 36 may further comprise first gap 37 therein that may be configured to functionally engage the interior wall 29 as the end caps 30 slide within the openings 22 and 24. The protuberances 36 may further comprise gap 39 therein that may be configured to functionally engage the opposing tabs 25*a* and 27*a* as the end caps 30 slide within the openings 22 and 24. In this way, the end cap 30 may be securely fit to and not easily detach from the first or second members 20 or 120. The engagement of the protuberances 36 within the openings 22 and 24 may be configured to prevent the end cap 30 from shifting side-to-side or up-and-down. The engagement of the gaps 37 and 39 may serve to additionally prevent the end cap 30 from spinning, twisting, or otherwise shifting with respect to the first or second members 20 or 120. In some embodiments, the gap 37 may be elongated to further ensure the secure fit of the end cap 30 on the first or second members 20 or 120 and help in preventing the end cap 30 from spinning, twisting, or otherwise shifting with respect to the first or second members 20 or 120. In addition, the end caps 30 may be further configured to be removable by user manipulation, as needed, from the first or second members 20 or 120. That is the end caps 30 may be configured to be releasably and repeatedly engaged on and disengaged from the first or second members 20 or 120, as desired by a user. In this way, interior component parts may be accessed, cleaned, repaired, replaced, etc., as needed. However, the structure of the protuberances 36 and associated gaps 37 and 39 prevent the end cap 30 from undesirably disengaging from the first or second members 20 or 120 without undue force.

Embodiments of the end caps 30 may further comprise the end caps 30 having a fastener post 33 configured on an interior of the end cap 30, the fastener post 33 being configured to receive the securing member 40 thereon to secure first and second members 20 and 120 to one another. In other words, the securing member 40 may be configured to have one end thereof be fixedly coupled to a fastener post 33 of one end cap 30 on either of the first and second members 20 and 120 and another end thereof be configured to be releasably and repeatedly coupled to a corresponding fastener post 33 in another end cap 30 on the other of the first and second members 20 and 120, such that the securing member 40 may releasably and repeatedly couple first and second members 20 and 120 to one another, as desired by the user. The securing member 40 may reach the fastener post 33 located within the interior of the end cap 30 through the aperture 32, as described above and displayed with reference to the Figures. Under the condition the device 10 is configured in the closed position, the securing member 40 may function to engage the fastener post 33 in the corresponding end caps 30 of the first and second members 20 and 120.

Embodiments of the end caps 30 may further comprise the end caps 30 having a cable post 35 configured on an interior of the end cap 30, the cable post 35 being configured to receive a cable 44 thereabout. The cable post 35 may be configured to secure a looped cable 44 thereabout and thereafter permit the looped cable 44 to move about, slide around, or otherwise transition with respect to the cable post 35. In other words, the cable post 35 may secure one end of the looped cable 44 thereto, but may permit the looped cable 44 to slide around or transition about the circumference of the cable post 35, as will be described in greater detail.

Figure 6:
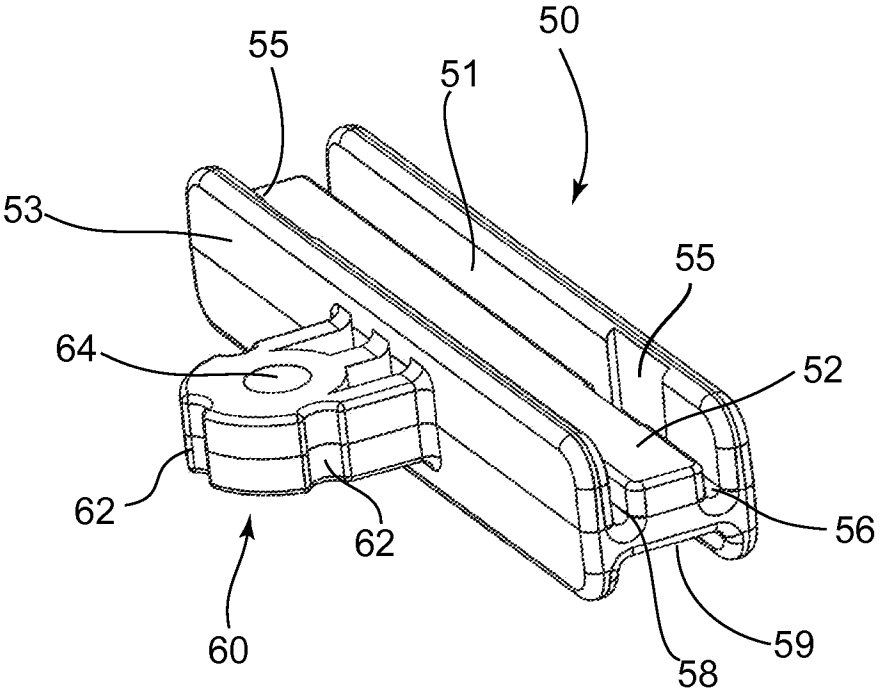
FIG. 6 is a perspective view of a component of an embodiment of a golf swing training device in accordance with the present disclosure.

As depicted in FIG. 6, embodiments of the device 10 further comprise a sliding mechanism 50. The sliding mechanism 50 may further comprise opposing sidewalls 51 and 53. Between opposing side walls 51 and 53, the sliding mechanism 50 may further comprise a detent 59 in a bottom surface thereof, the detent 59 being configured between the side walls 51 and 53, so as to not contact the interior surface of the opening 22 under the condition the sliding mechanism 50 is inserted within the opening 22, which reduces the friction between the sliding mechanism 50 and the opening 22 as the sliding mechanism 50 transitions within the opening 22. The detent 59 may run between the sidewalls 51 and 53 along the entire bottom surface of the sliding mechanism 50. The sliding mechanism 50 may further comprise a detention 54 in a top surface thereof. The detention 54 may run between the sidewalls 51 and 53 along the entire top surface of the sliding mechanism 50. The detention 54 may be configured such that it does not contact the interior surface of the opening 22 under the condition the sliding mechanism 50 is inserted within the opening 22, which reduces the friction between the sliding mechanism 50 and the opening 22 as the sliding mechanism 50 transitions within the opening 22. The detention 54 may further comprise a ridge 52 rising up off of a central portion of the detention 54, the ridge 52 being configured such that the ridge 52 may run lengthwise along the sliding mechanism 50 and define on either side thereof, between respective sidewalls 51 and 53, grooves 56 and 58. The grooves 56 and 58 may run length-wise along the sliding mechanism 50 and also run substantially parallel with one another. The grooves 56 and 58 may be configured to house, receive, or otherwise channel the cable 44 therein. For example, one side of the looped cable 44 may reside and be capable of transitioning within the groove 56, whereas the opposing side of the looped cable 44 may reside and be capable of transitioning in the groove 58. As the cable 44 moves, the side of the cable 44 in the groove 56 moves in an opposite direction to the movement of the side of the cable 44 in the groove 58. Such opposite movement is facilitated by the cable 44 being wrapped around and engaged by the cable post 35.

In some embodiments, the cable 44 may be fixed relative to one of the grooves 56 and 58, but move relative to the other of the grooves 56 and 58. For example, one or more of the sidewalls 51 or 53 may further comprise a recess 55 in an interior portion thereof, the recess 55 being configured to receive and retain a bracket 46. The bracket 46 may be further configured to couple to one side of the looped cable 44, such that as the cable 44 moves, or otherwise transitions back and forth, so too does the bracket 46, or vice versa. It follows that with the bracket 46 being also coupled to the sliding mechanism 50 via the recess 55, as the bracket 46 moves, or otherwise transitions, so too does the sliding mechanism 50. Likewise, as the cable 44 is moved, so too does the sliding mechanism 50, or vice versa. As the sliding mechanism 50 moves, the looped cable 44 may be fixed, as described above, relative to one of the grooves 56 or 58, i.e., the groove 56 or 58 proximate the recess 55. The opposite side of the looped cable 44 may transition in the opposing groove of grooves 56 or 58

Embodiments of the device 10 may further comprise one or more sliding mechanisms 50 being inserted within the opening 22. As such, the exterior of the sidewalls 51 and 53 may contact or communicate with the interior of the opening 22. Indeed, the opening 22 may function as a type of track, within which the sliding mechanism 50 may transition along a length of the first and second members 20 and 120. The sidewalls 51 and 53 may be configured to prevent the sliding mechanism 50 from rotating within the opening 22. As such, the sliding mechanism 50 may be configured to transition in more or less a straight line along the length of the opening 22 inside the first and second members 20 and 120.

Embodiments of the device 10 further comprise the sliding mechanism 50 comprising an extension 60 that extends outwardly from an exterior surface of the sliding mechanism 50. For example, the extension 60 may extend from one of the sidewalls 51 or 53 of the sliding mechanism 50. The extension 60 may be configured to protrude through the slit 26 in the first member 20, between the tabs 25*a* and 27*a*. Also, the extension 60 may be aligned at a central location on the sliding mechanism 50 to provide stability to the extension 60, which may have a pivot member 70 coupled thereto, which may have a positioning member 80 coupled thereto.

Embodiments of the device 10 may further comprise the extension 60 having an extension through bore 64 and surface features 62. The extension 60 may comprise one or more surface features 62. The surface features 62 may be positioned, or otherwise configured on an exterior or edge surface of the extension 60. The surface features 62 may be structured to provide resistance to movement of a pivot member 70 that may be configured to pivot in relation to the extension 60 and about the extension 60. The surface features 62 may function as detents that communicate with the pivot member 70 to provide resistance to unwanted movement of the pivot member 70 about the extension 60. The surface features 62 may also function to resist movement in a plurality of directions. The surface features 62 may be configured to provide resistance to movement of the pivot member 70 at more than one position of the pivot member 70. The surface features 62 may be positioned incrementally about the exterior surfaces of the extension 60, such that each surface feature 62 may separately and independently engage the pivot member 70 to position the pivot member 70 in the desired location.

Figure 7:
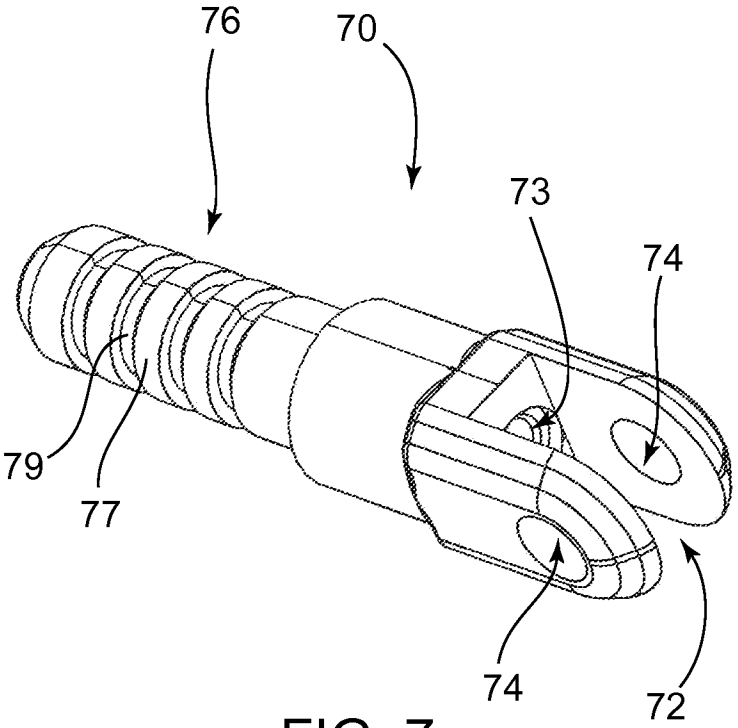
FIG. 7 is a perspective view of a component of an embodiment of a golf swing training device in accordance with the present disclosure.

As depicted in FIG. 7, embodiments of the device 10 further comprise the pivot member 70. The pivot member 70 may further comprise a space 72 defined between opposing surfaces of the pivot member 70. The space 72 may be configured to receive therein the extension 60 that protrudes from the slit 26 outside of the first member 20. In other words, the extension 60 extends outside of the first member 20 through the slit 26 so that the extension 60 may fit within the space 72 and functionally engage the pivot member 70. The pivot member 70 may further comprise a pivot through bore 74. The pivot through bore 74 may be axially aligned with the extension through bore 64. A fastener 71 may be inserted into the pivot through bore 74 and the extension through bore 64 to functionally couple the pivot member 70 and the sliding mechanism 50 together. In addition, the pivot member 70 may further comprise a coupling portion 76 that may be configured to couple thereto a positioning member 80. The coupling portion 76 may comprise a series of surface features for a friction fit arrangement with the positioning member 80. The coupling portion 76 may have peaks 77 and valleys 79 that alternate one with another along an axial length of the coupling portion 76. The alternating peaks 77 and valleys 79 may serve to grip or otherwise secure by friction fit the positioning member 80 to the pivot member 70.

Embodiments of the device 10 may further comprise the pivot member 70 having an axially aligned bore 73 that may be configured to receive therein an abutment member 78. The abutment member 78 may be configured to functionally engage and communicate with the surface features 62 of the extension 60. A user may apply force to the pivot member 70 to pivot the pivot member 70 about the extension 60. When the abutment member 78 communicates with one of the surface features 62, the effect is that the surface feature 62 retains or holds the abutment member 78 therein to retain or maintain the position of the pivot member 70. The user may apply greater force to release the abutment member 78 from engagement with the surface feature 62 to thus pivot the pivot member 70 to another position relative to the extension 60. The user may even engage the abutment member 78 in another surface feature 62 to reposition the pivot member 70 with respect to the extension 60.

With reference again to FIGS. 1-5, embodiments of the device 10 may further comprise the positioning member 80 being a cylindrical-shaped protrusion, such as a rod or a shaft, that has a length. Embodiments of the device 10 may include the positioning member 80 having one or more predetermined lengths. Embodiments of the device 10 may include the positioning member 80 having variable lengths. Embodiments of the device 10 may include the positioning member 80 having a predetermined, fixed length. Embodiments of the device 10 may include the positioning member 80 being configured to telescope between a minimum length and a maximum length, such that the length of the positioning member 80 is adjustable by the golfer. Embodiments of the device 10 may include the positioning member 80 being configured to receive an insert 81. The insert 81 may be configured to be placed within the hollow interior of the positioning member 80, such that the insert 81 may move in and out of the interior of the positioning member 80 to telescope from the positioning member 80, to effectively increase the length of the positioning member 80. Embodiments of the device 10 may include the positioning member 80 being configured to be detachable from the pivot member 70 as desired by the golfer. For example, the positioning member 80 may be screwed onto corresponding grooves on the coupling portion 76, may be press-fit onto the coupling portion 76, may be snapped into the coupling portion 76 via a quick-release mechanism. As depicted, the positioning member 80 may be press fit onto the coupling portion 76 of the pivot member 70.

Figure 5:
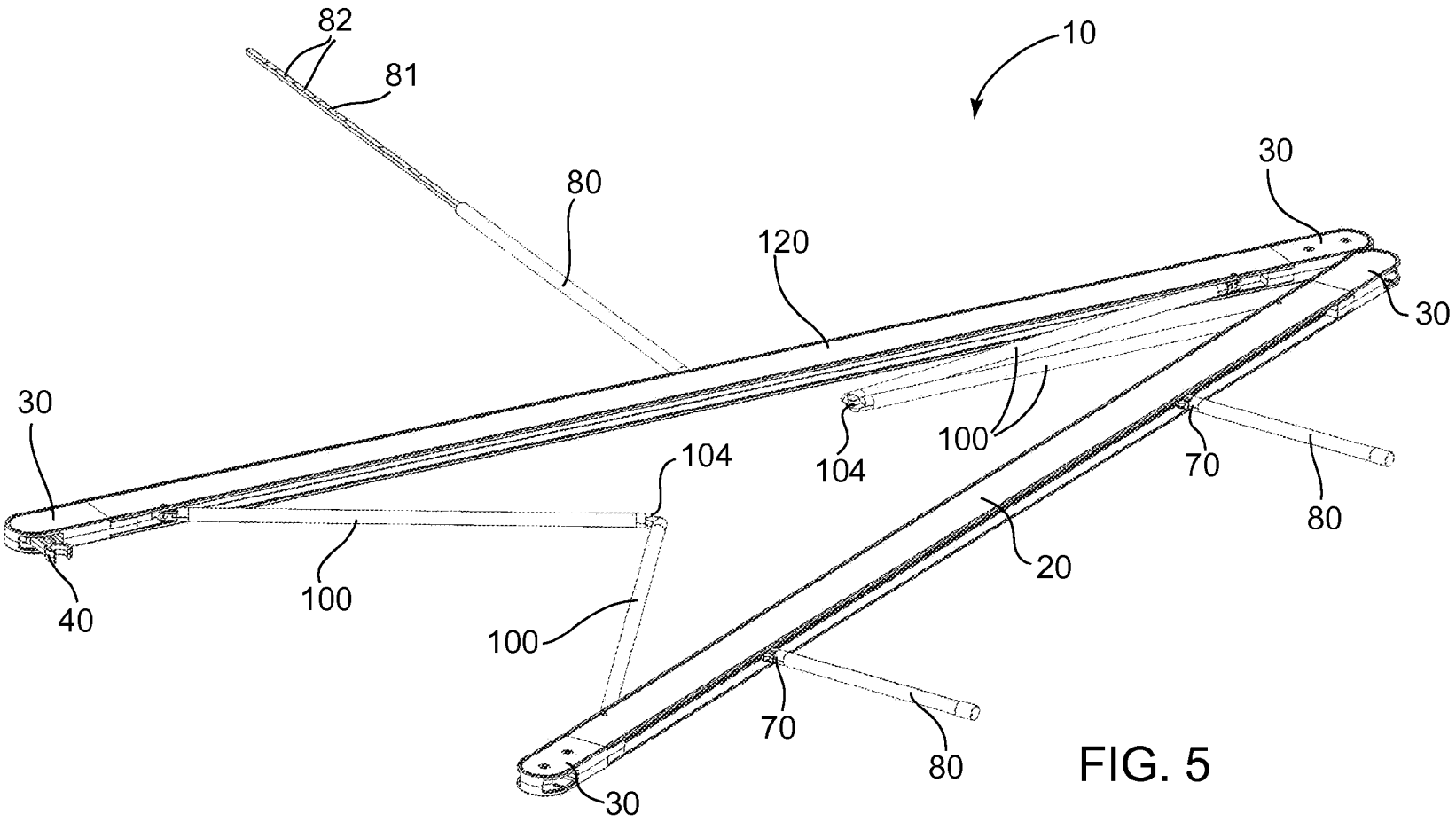
FIG. 5 is a perspective view of an embodiment of a golf swing training device in accordance with the present disclosure.

With reference to FIG. 5, embodiments of the device 10 may include the positioning member 80 having indicators 82 thereon, such as lines, grooves, labels, or other visual markers, that correspond to where the golfer should place the feet, shoulders, golf club, and/or golf ball depending upon which golf shot the golfer desires to make. In addition, the indicators 82 may help the golfer in the selection of the golf club needed to make the desired golf shot. Embodiments of the device 10 may include the indicators 82 being set at predetermined intervals. Embodiments of the device 10 may include the indicators 82 being set at predetermined intervals and labeled with particular golf clubs, each interval being labeled with a separate golf club type.

Embodiments of the device 10 may further comprise the pivot member 70 being configured to pivot, or otherwise rotate, about the extension member 60 in about 180 degrees of motion. Within this range, the pivot member 70 may pivot between a stored position and an in-use position. The stored position may be the position in which the pivot member 70 is moved with respect to the extension 60 to place the positioning member 80 that is coupled to the pivot member 70 in a position parallel with the length of the first member 20. In contrast, the in-use position may be the position in which the pivot member 70 is moved with respect to the extension 60 to place the positioning member 80 in a position orthogonal to the length of the first member 20, as depicted in FIG. 1.

Embodiments of the device 10 further comprise the one or more sliding mechanisms 50 being positioned within the opening 22 of the first member 20 or the second member 120. On each sliding mechanism 50 a corresponding bracket 46 may be functionally coupled to the appropriate recess 55. The bracket 46 may functionally engage the cable 44, such that as the cable 44 moves, so too do each of the sliding mechanisms 50 functionally engaged thereto, as described herein. Likewise, as the sliding mechanism 50 move, so too does the cable 44, as described herein. One advantage of coupling the sliding mechanisms 50 to the cable 44 via the brackets 46 and recess 55 is the ease in positioning the sliding mechanisms 50 with respect to the first member 20. For example, each sliding mechanism 50 may have coupled thereto a corresponding pivot member 70, which may have coupled thereto a corresponding positioning member 80. Accordingly, a user may be desirous to reposition one or more positioning members 80 with respect to the first member 20. In some embodiments, the distance between positioning members 80 along the length of the first member 20 may be advantageous to a particular type of golf shot. Further, it may be advantageous to have the positioning members 80 move closer to one another or further away from one another along the length of the first member 20 by simply moving one of the positioning members 80. For example, a user may be desirous to position the positioning members 80 at a distance apart from one another that corresponds to the shoulder width of the user. The user may position the positioning members 80 accordingly by holding the device 10 in one hand and using the free hand to grip one of the positioning members 80 to concurrently move both the positioning members 80 closer to or further away from one another. To effectuate concurrent movement of the positioning members 80 closer to or further away from one another at the same time, each of the positioning members 80 may be functionally coupled to the looped cable 44 (via a corresponding sliding mechanism 50) such that movement of one of the positioning members 80 in one direction correspondingly moves the other of the positioning members 80 in the opposite direction, such that the positioning members 80 concurrently move toward one another or away from one another depending on which direction one of the positing members 80 is moved. This may be accomplished by coupling each of the sliding mechanisms 50 to an opposing loop/side of the looped cable 44. The cable 44 is configured to be a continuous cable 44 without end. For example, the looped cable 44 is configured about the cable post 35 on opposing end caps 30, such that as the cable 44 is transitioned about the cable posts 35, one side of the looped cable 44 travels in one direction along the length of the first member 20 and the opposing side of the cable 44 travels in the opposite direction along the same length. As such, one sliding mechanism 50 may be coupled to one side of the looped cable 44, as described herein, and the other sliding mechanism 50 may be coupled to the other side of the looped cable 44, as described herein. In this way, the configuration of the cable 44 about the cable posts 35 and the coupling of the sliding mechanisms 50 to opposite sides of the cable 44 can cause the sliding mechanisms 50 to move in opposite directions when force is applied by the user to one of the sliding mechanisms 50 via the pivot member 70 and positioning member 80.

Embodiments of the device 10 further comprise coupling arms 100. The coupling arms 100 may be configured to functionally couple at coupling point 90 to the first member 20 and to the second member 120. Each of the coupling arms 100 may be configured to have through bores 102 positioned in at least one distal end of the angle arm 100. By way of the through bores 102, each of the coupling arms 100 may be functionally coupled to either of the first member 20 or the second member 120. For example, the distal end of the coupling arm 100 that has the through bore 102 therein may be inserted within the slit 28 and into the opening 24 of the first or second members 20 or 120. The first and second members 20 and 120 may have a corresponding through bore 123 therein. As such, the through bore 102 of the coupling arm 100 and the through bore 123 of the first or second member 20 or 120 may be aligned such that a fastener 121 may be inserted therein to secure, fasten, or otherwise couple the distal end of the coupling arm 100 to the first or second member 20 or 120 in the opening 24. The coupling of the coupling arm 100 and the first or second member 20 or 120 may be such that the coupling arm 100 may pivot with respect to the first or second member 20 or 120. Moreover, the coupling arm 100 may be configured to have a diameter that is less than the length of the opening of the slit 28. As such, the coupling arm 100 may pivot with respect to the first or second member 20 or 120 such that the coupling arm 100 can be at least partially concealed or entirely contained within the opening 24 through the slit 28. Likewise, the coupling arm 100 may pivot with respect to the first or second member 20 or 120 such that coupling arm 100 is orthogonal to the length of the first or second member 20 or 120 and the distal end of the coupling arm 100 is the only portion of the coupling arm 100 concealed within the opening 24 through the slit 28.

Embodiments of the device 10 may further comprise a plurality of coupling arms 100 being coupled, as described above, to each of the first and second members 20 and 120. As depicted, two coupling arms 100 are coupled, as described above, to each of the first member 20 and the second member 120.

Embodiments of the device 10 may further comprise the coupling arms 100 being configured to functionally couple to one another at a pivot point 104. For example, a coupling arm 100 coupled to the first member 20 may functionally couple to a corresponding coupling arm 100 that is functionally coupled to the second member 120. To functionally couple to one another, each of the free ends of the coupling arms 100 may be configured to receive therein the coupling portion 76 of a corresponding pivot member 70, much like the positioning member 80 being configured to receive therein, or be positioned on, the coupling portion 76 of the pivot member 70. Thereafter, a coupling member 107 may be inserted within each of the openings 72 in the pivot members 70 attached to each free end of the coupling arms 100. The coupling member 107 may have a plurality of through bores positioned therein to correspond with the through bore 74 of the pivot member 70. Once the through bores of the coupling member 107 are aligned with the through bores 74 of each of the pivot members 70, the fastener 71 may be inserted therein to functionally couple the coupling member 107 to each of the pivot members 70, to effectively functionally couple the coupling arms 100 to one another at the pivot point 104. The configuration of the pivot members 70 permits the coupling arms 100 coupled together at the pivot point 104 to pivot with respect to one another.

The coupling arms 100 may be configured to pivot to permit the first and second members 20 and 120 to be positioned in parallel proximate one another. In this closed position, the coupling arms 100 may be concealed, contained, or housed within the opening 24 in the corresponding first or second member 20 or 120. The coupling arms 100 may be configured to pivot to permit the first and second members 20 and 120 to be oblique with respect to one another. In this oblique or angled position, the coupling arms 100 may be partially concealed, contained, or housed within the opening 24 in the corresponding first or second member 20 or 120, depending upon the angle at which the first and second members 20 and 120 are positioned with respect to one another. The coupling arms 100 may be configured to pivot to permit the first and second members 20 and 120 to be positioned in parallel and spaced apart from one another. In this open position, the distal ends of the coupling arms 100 may be the only portions of the coupling arms 100 that are concealed, contained, or housed within the opening 24 in the corresponding first or second member 20 or 120. Indeed, the coupling arms 100 may be configured to pivot such that they may be orthogonal to the length of the first and second members 20 and 120, such that the coupling arms 100 may essentially lie in parallel with one another in a single file line between the first and second members 20 and 120.

Embodiments of the device 10 may further comprise the second member 120 having one or more sliding mechanisms 50 configured in the opening 22 thereof. As depicted, the second member 120 may have a single sliding mechanism 50 configured in its corresponding opening 22. The sliding mechanism 50 may have coupled thereto a pivot member 70 and a positioning member 80. The positioning member 80 may be a positioning member 80 configured with the insert 81 therein, such that the positioning member 80 on the second member 120 may extend its effective length via the insert 81 to position a golf ball 16 at variable distances away from the second member 120, as determined by the user. For example, using one type of golf club 14 may require the golf ball 16 to be positioned relatively further away from the golfer, and thus the second member 120. Other types of golf clubs 14 may require the golf ball 16 to be positioned relatively closer to the golfer, and thus closer to the second member 120. The insert 81 may have indicators 82 thereon. The indicators 82 may be labeled for and correspond to each type of golf club 14 that a golfer may utilize to hit a particular golf shot. The indicators 82 may be set at predetermined intervals from one another and may be labeled according to the golf club type. For example, the driver is longer than other types of golf clubs and thus the golf ball 16 should be set relatively further away from the golfer. Similarly, a pitching wedge is a short iron and the golf ball 16 should be set relatively closer to the golfer. As a result, the golfer may move the insert 81 in and out of the positioning member 80 to select the appropriate indicator 82 for the type of golf club to be used. To line up the correct indicator 82, the golfer should place the desired indicator 82 at the distal end of the positioning member 80.

Moreover, the structural configuration between pivot member 70 and the extension 60 on the sliding mechanism 50, as previously described, may function to allow the positioning member 80 on the second member 120 to pivot, or otherwise rotate, about the extension 60 in about 180 degrees of motion. Within this range, the positioning member 80 and thus the pivot member 70 may pivot between a stored position and an in-use position. The stored position may be the arrangement in which the pivot member 70 is moved with respect to the extension 60 to place the positioning member 80 coupled to the pivot member 70 in a position parallel with the length of the second member 120. In contrast, the in-use position may be the arrangement in which the pivot member 70 is moved with respect to the extension 60 to place the positioning member 80 in a position orthogonal to the length of the second member 120.

Embodiments of the device 10 may further comprise the second member 120 having indicators 82 thereon for indicating golf ball placement with respect to the golfer's feet and according to the golf club 14 selected by the golfer 12 to effectuate the desired golf shot. The indicators 82 may be configured on the exterior of the top surface 25 of the second member 120. For example, the positioning member 80 coupled to the sliding mechanism 50 in the second member 120 may be positioned at a position along the length of the second member 120 by sliding the sliding mechanism 50 within the opening 22 along the second member 120 until the positioning member 80 is at a designated position determined by the indicators 82 according to the type of golf shot to be executed and/or the type of golf club to be used. The indicators 82 may be labeled for and correspond to each type of golf club 14 that a golfer may utilize to hit a particular golf shot. The indicators 82 may be set at predetermined intervals from one another and may be labeled according to the golf club type. For example, the driver should be set forward in the golfer's stance, and thus the indicator 82 corresponding to the driver may be the forward-most indicator 82 on the second member 120. Similarly, a pitching wedge, or other similar wedge, should be set back in the golfer's stance, and thus the indicator 82 corresponding to the pitching wedge may be one of the last, if not the last, indicator 82 along the length of the second member 120. The various middle irons follow a similar pattern therebetween. The indicators 82 on the second member 120 may be attached by adhesive to the top surface 25 of the second member 120, so that the indicators 82 may be customizable according to the particular golfer's preference. Moreover, the predetermined distance between indicators 82 according to club type may be determined by an individual golfer and customized on the second member 120 accordingly. Alternatively, the indicators 82 may be etched or otherwise permanently marked in the second member 120.

Embodiments of the device 10 include the device 10 being configured to allow the golfer 12 to determine the desired positioning of the golf ball 16 in the golfer's stance. For example, each of the sliding mechanisms 50 is independently adjustable with respect to one another, except that the sliding mechanisms 50 coupled to the cable 44 will move in unison, as described above. Thus, the golfer 12 may customize the width of the golfer's stance by moving the positioning members 80 on the first member 20 as desired. The golfer may also customize how far forward or backward the golf ball 16 is placed in the golfer's stance based on club selection by moving the positioning members 80 on the second member 120 to the desired position as indicated by the indicators 82 for the club selected.

Figure 8:
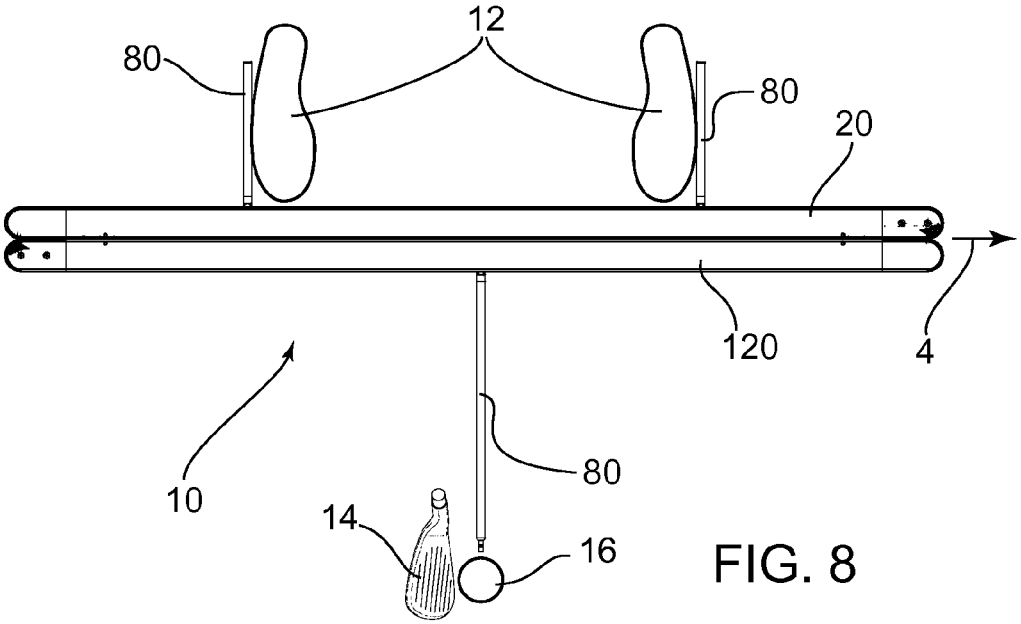
FIG. 8 is a perspective view of a golf swing training device in accordance with the present disclosure.

As depicted in FIG. 8, embodiments of the device 10 may further comprise a golfer 12 and the device 10. A golfer 12 may position the device 10 on the ground, such as the grass on the golf course, the driving range, the backyard, or whatever other relatively flat surface the golfer 12 can find to use. Once on the ground, the device 10 may be set parallel to the target line between the golf ball 16 and the intended target. As depicted, the first member 20 may be configured and positioned side-by-side with the second member 120, such that the first member 20 and the second member 120 are in physical contact with one another in a closed position. In this configuration, the coupling arms 100 are positioned at least partially within the corresponding openings 24 of the first member 20 and the second member 120, respectively. In addition thereto, the securing member 40 may be functionally coupled to the corresponding fastener posts 33 in the first and second members 20 and 120, such that the second member 120 is functionally coupled to the first member 20 to maintain the physical configuration between the first member 20 and the second member 120 in the closed position.

In the closed position, the golfer 12 may adjust one or more of the sliding mechanisms 50 in the first member 20 facing the golfer. The sliding mechanisms 50 may be slid within the opening 22 and the slit 26 until the sliding mechanisms 50 are arranged to be about the golfer's shoulder width apart. Also, the golfer 12 may adjust the pivot members 70 coupled to the respective sliding mechanism 50 to transition the pivot member 70, and thus the positioning member 80, from the stored position parallel to the length of the first member 20 to the in-use position orthogonal to the first member 20. If needed, or if desired, the golfer may pick up the device 10 and, with the positioning member 80 in the in-use position, arrange the sliding mechanisms 50 until the respective positioning member 80 touches the golfer's shoulders on outside of either shoulder of the golfer. Thereafter, the golfer may position the device 10 on the ground and may place the outside of his/her feet up against the inside of the rods 80, as shown in FIG. 8.

The golfer may also adjust the sliding mechanism 50 to the desired position up and down the length of the second member 120. The second member 120 may have indicators 82 marked thereon, such as lines, grooves, labels, or other visual markers, that correspond to where the golfer 12 should place the golf ball 16 within the width of the golfer's stance depending upon which golf shot the golfer 12 desires to make. In addition, the indicators 82 on the second member 120 may help the golfer 12 in the selection of the golf club 14 needed to make the desired golf shot. The golfer 12 may transition the positioning member 80 on the second member 120 from the stored position to the in-use position by transitioning the pivot member 70 about the extension 60, as described herein. Whether in the stored position or in the in-use position, the golfer may nevertheless move the sliding mechanism 50 on the second member 120 forward or backward (along the length of the second member 120) in the golfer's stance depending on the club selected and the shot desired.

In addition to the above, the distance the golf ball 16 should be placed away from the user's feet may also be determined by using the device 10. For example, the golf ball 16 may be placed at a distance away from the second member 120 depending upon the club selected by the golfer 12. The insert 81 may have indicators 82 marked thereon at regular intervals, the intervals corresponding to the distance away from the second member 120 the ball 16 should be placed depending upon which club 14 the golfer 16 desires to use. As mentioned above, the insert 81 may telescope with respect to the positioning member 80 that houses the insert 81. In other words, the golfer 12 may pull on the insert to telescope the insert 81 out of the positioning member 80 a distance away from the second member 120 to the point where the indicator 82 on the insert 81 indicates that the golfer 12 should stop pulling depending upon which club 14 the user desires to swing. Thus, the distance the insert 81 is telescoped, or otherwise moved, away from the second member 120 is dependent upon which club 14 the golfer 12 selects. And, the indicators 82 on the insert 81 may correspond to the distance the golf ball 16 should be positioned away from the second member 120 to make a proper golf shot depending upon the golf club 14 selected.

Once the sliding mechanisms 50 are in place, the golfer 12 may use the device 10 to address the golf ball 16 by positioning his/her feet as described herein, by positioning the golf ball 16 as described herein, and by positioning the golf club face as described herein. Positioned as such, the device 10 may assist the golfer 12 in taking a straight swing and hitting a straight shot. For example, the second member 120 and the first member 20, given that the two are in contact with one another, each point in a direction of the intended target along a line 4, indicated by the arrow depicted in FIG. 8, that is parallel with the target line. Thus, the golfer 12 may utilize the second member 120 and/or the first member 20 to take a swing that follows the target line, which is parallel to the second member 120 and first member 20. In addition, the golfer 12 may align the club face perpendicular to the target line, or, perpendicular to the length of the second member 120 and/or the first member 20. Thus, a golf swing trajectory that follows the length of the second member 120 or the first member 20 and a club face that is perpendicular to such will likely result in a straight and accurate golf shot. A full swing may be utilized in this closed configuration.

In addition to a full swing, a putting stroke may also be utilized in this closed configuration. Under the condition the golfer 12 desires to execute a putting stroke with the device 10, or train for a better putting stroke, the golfer 12 may place the device 10 in the closed position on the ground surface with the first and second members 20 and 120 proximate one another, or even right next to one another so they are touching one another. In addition thereto, the golfer 12 may desire to place the golf ball 16 proximate the second member 120, such that the golfer 12 may swing the putter right next to the second member 120. In this way, when the golfer makes a putting stroke, the golfer 12 may utilize the length of the second member 120 and the straightness thereof as a reference point for the putting stroke. Indeed, by placing the ball 16 next to the second member 120, the golfer 12 may better train his/her putting stroke to be a straight back and forth pendulum-type swing right along the length, or the partial length, of the second member 120. To position the ball 16 next to the second member 120, the positioning member 80 on the second member 120 may be pivoted to the stored position, wherein the length of the positioning member 80 is parallel with the length of the second member 120, such that the golf ball 16 may be positioned very close to the second member 120. In some embodiments, the positioning member 80 may even be placed within the opening 22 in the second member 120 so that the positioning member 80 is hidden therein and out of sight. With the positioning member 80 out of the way, the golf ball 16 may be placed next to the second member 120 without the positioning member 80 interfering. Thus, the putting stroke may be executed right along the length of the second member 120 to direct the putting stroke, or at least provide a reference for a straight putting stroke.

Moreover, in the closed position, with all of the positioning members 80 stored in a position parallel the length of the first and second members 20 and 120, or even hidden within the respective openings 22, the device 10 may be easily transported or stored. Indeed, the device 10, in this configuration may be inserted in a golfer's golf bag and carried around the course with the golfer during a round of golf or stored therein between rounds of golf.

Figure 9:
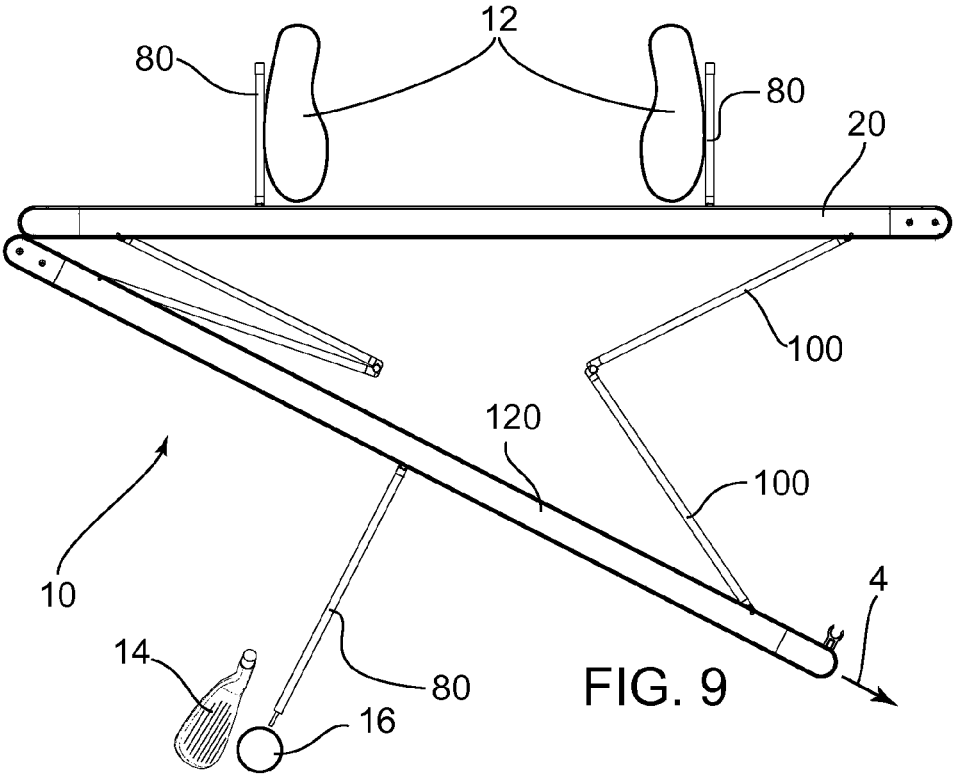
FIG. 9 is a perspective view of a golf swing training device in accordance with the present disclosure.
Figure 10:
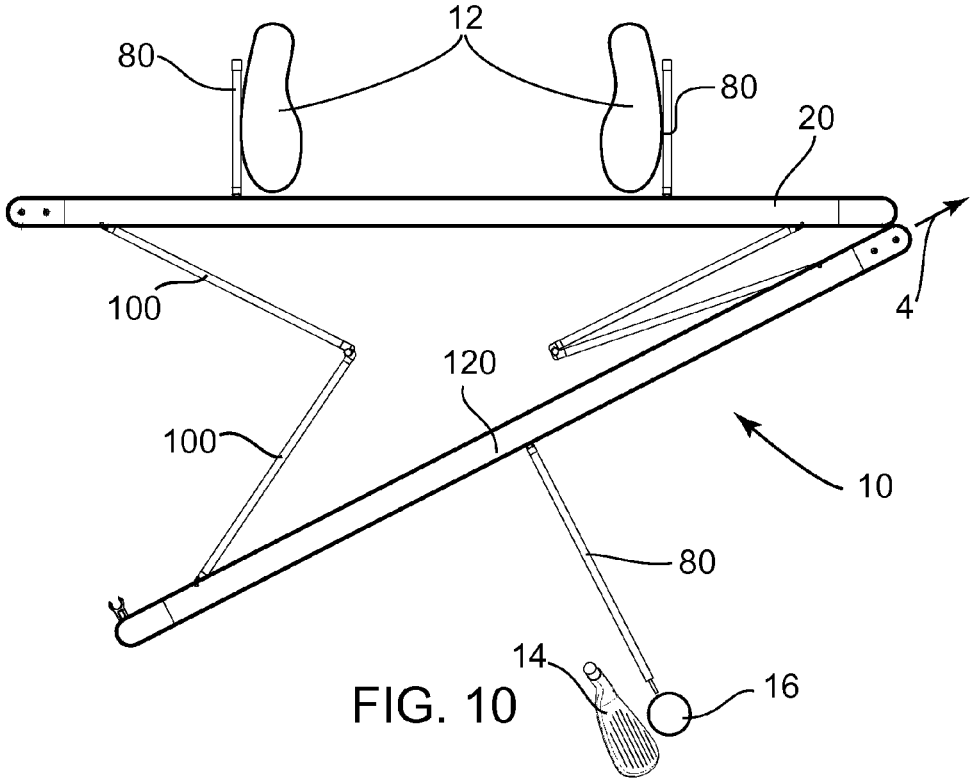
FIG. 10 is a perspective view of a golf swing training device in accordance with the present disclosure.

Embodiments of the device 10 include the device 10 being configured to instruct the golfer 12 to also shape a golf shot. In other words, by properly utilizing the device 10, the golfer 12 can execute controlled and deliberate golf shots, including, but not limited to, a straight golf shot, a putt, a fade golf shot, and a draw golf shot, as determined by the golfer 12 depending upon the conditions of the golf course. For example, to shape golf shots, the second member 120 may be moved from the closed position to an angled position, wherein at least a portion of the second member 120 is moved away from the first member 20, as depicted in FIGS. 9 and 10. The structural configuration of the device 10 described herein accomplishes the movement of the first member 20 and the second member 120 relative to one another as described. Specifically, the coupling arms 100 and their corresponding coupling to one another at pivot point 104 and to the first and second members 20 and 120 permits the first and second members 20 and 120 to pivot away from one another at either of the corresponding first ends 21 or corresponding second ends 23, depending on the shot selection of the golfer 12, as will herein be described.

As depicted in FIG. 9, the forward portion, i.e. the target side, of the device 10 is configured to permit the first member 20 and the second member 120 to be positioned slightly apart from one another, while the rearward portion of the first member 20 and the second member 120 remain in contact with, or at least in relative close proximity to, one another. By opening up the second member 120 from the first member 20 at the target side of the device 10 while leaving the second member 120 and the first member 20 close together at the rearward side allows the golfer 12 to properly address the golf ball 16 to execute a fade golf shot. The golfer 12 may line up the fade golf shot by placing the second member 120 on the line 4 that is parallel to the target line between the golf ball 16 and the target. Because the first member 20 and the second member 120 are spaced apart, the length of the first member 20 now points slightly to the left of the target. The golfer 12 then places his/her feet in parallel with the first member 20, as described herein, such that the golfer's toes touch the first member 20 and the outside of each of the golfer's feet touch the corresponding positioning members 80 as adjusted and set by the corresponding sliding mechanisms 50. This configuration places the golfer's feet in a slightly "open" position, meaning the golfer's feet are positioned to hit the golf ball 16 to the left of the intended target, or in the same direction as the direction designated by the length of the first member 20, whereas at the same time, the length of the second member 120 continues to point in the direction of the intended target. With the golfer's feet in the "open" position, the golfer should also align the hips and shoulders in parallel with the golfer's feet, such that the golfer's entire body is in an "open" position.

With the golfer's body in the "open" position, the golfer 12 may address the golf ball 16. Utilizing the second member 120 and/or the positioning member 80, the golfer 12 may properly align the golf club face to the golf ball 16 to execute the fade shot. The positioning member 80 on the second member 120 may be moved to the corresponding indicator 82 that coincides with the type of golf club selected by the golfer. Moreover, the insert 81 may be adjusted to the proper indicator 82 on the insert to adjust the effective length of the positioning member 80 on the second member 120 according to the club selected to position the golf ball 16 at the proper length away from the golfer 12.

A typical fade shot requires that the face of the club 14 be slightly open at the point in the swing where the golf club 14 impacts the golf ball 16. By so doing, the golf club 12 translates the proper spin to the golf ball 16 to execute a fade shot, wherein the spin of the golf ball 16 causes the golf ball 16 to travel left-to-right in the air. By utilizing the device 10, the golfer 12 may easily and efficiently position the golf club face in this proper orientation to execute the fade shot. For example, the golfer 12 may square the club face to the direction of the intended target by placing the club face perpendicular to the length of the second member 120, which length is parallel to the target line. With golfer's body position being "open" and the club face being initially parallel with the second member 120, the golfer 12 is properly positioned and ready to execute a fade shot using the device 10. The golfer 12 may execute the fade shot by making a swing that follows the trajectory of the length of the first member 20, or that follows the golfer's "open" stance. In other words, because the golfer's body is in an "open" position, the golfer's regular swing will become a swing that is a little bit outside-in with respect to the ball 16 and the target line. This outside-in swing will cause the club face that was initially perpendicular to the target line, and thus the second member 120, at the start of the swing to impact the golf ball 16 in a slightly "open" position, which will impart a spin on the golf ball 16 that causes its resulting flight to travel left-to-right.

As depicted in FIG. 10, the rearward portion of the device 10 is configured to permit the first member 20 and the second member 120 to be positioned slightly apart from one another, while the forward portion, i.e. the target side, of the first member 20 and the second member 120 remain in contact with, or at least in relative close proximity to, one another. By opening up the second member 120 from the first member 20 at the rearward side of the device 10 while leaving the second member 120 and the first member 20 close together at the target side allows the golfer 12 to properly address the golf ball 16 to execute a draw golf shot. The golfer 12 may line up the draw golf shot by placing the second member 120 on the line 4 that is parallel to the target line between the golf ball 16 and the target. Because the first member 20 and the second member 120 are spaced apart, the length of the first member 20 now points slightly to the right of the target. The golfer 12 then places his/her feet in parallel with the first member 20, as described herein, such that the golfer's toes touch the first member 20 and the outside of each of the golfer's feet touch the corresponding positioning members 80 set by the sliding mechanisms 50. This configuration places the golfer's feet in a slightly "closed" position relative to the golf ball, meaning the golfer's feet are positioned to hit the golf ball 16 to the right of the intended target, or in the same direction as the direction designated by the length of the first member 20, whereas at the same time, the length of the second member 120 continues to point in the direction of the intended target along line 4. With the golfer's feet in the "closed" position, the golfer 12 should also align the hips and shoulders in parallel with the golfer's feet, such that the golfer's entire body is in a "closed" position.

With the golfer's body in the "closed" position, the golfer 12 may now properly address the golf ball 16 with the golf club 14. Utilizing the second member 120 and/or the positioning member 80, the golfer 12 may properly align the golf club face to the golf ball 16 to execute the draw shot. The positioning member 80 on the second member 120 may be moved to the corresponding indicator 82 that coincides with the type of golf club selected by the golfer. Moreover, the insert 81 may be adjusted to the proper indicator 82 on the insert to adjust the effective length of the positioning member 80 on the second member 120 according to the club selected to position the golf ball 16 at the proper length away from the golfer 12.

A typical draw shot requires that the face of the club 14 be slightly closed at the point in the swing where the golf club 14 impacts the golf ball 16. By so doing, the golf club 12 translates the proper spin to the golf ball 16 to execute a draw shot, wherein the spin of the golf ball 16 causes the golf ball 16 to travel right-to-left in the air. By utilizing the device 10, the golfer 12 may easily and efficiently position the golf club face in the proper orientation to execute the draw shot. For example, the golfer 12 may square the club face to the direction of the intended target by placing the club face perpendicular to the length of the second member 120, which length is parallel to the target line. With golfer's body position being "closed" and the club face being initially parallel with the length of the second member 120, the golfer 12 is properly positioned and ready to execute a draw shot using the device 10. The golfer 12 may execute the draw shot by making a swing that follows the trajectory of the length of the first member 20, or that follows the golfer's "closed" stance. In other words, because the golfer's body is in a "closed" position, the golfer's regular swing will become a swing that is a little bit inside-out with respect to the ball 16 and the target line. This inside-out swing will cause the club face that was initially perpendicular to the target line at the start of the swing to impact the golf ball 16 in a slightly "closed" position, which will impart a spin on the golf ball 16 that causes its resulting flight to travel right-to-left.

Embodiments of the device 10 include the device having angle indicators 83 on the device 10, such as on the coupling arms 100 or on the first member 20 and/or second member 120 to indicate the degree to which the second member 120 and the first member 20 can be pivoted away from one another. By utilizing the indicators 83 to measure or indicate the degree to which the second member 120 and the first member 20 are pivoted away from one another, the resulting effect of the fade or draw in the corresponding golf shot can be determined. For example, the greater the distance between the second member 120 and the first member 20, the greater the effect of the fade or draw on the corresponding golf shot. Likewise, the smaller the distance between the second member 120 and the first member 20, the smaller the effect of the fade or draw on the corresponding golf shot. Thus, the indicators 83 may assist the golfer 12 in determining the proper positioning of the second member 120 relative to the first member 20 to execute the desired movement of the golf ball 16 relative to the intended target. In some embodiments of the device 10, the indicators 83 may range between 5 and 35 degrees.

Figure 11:
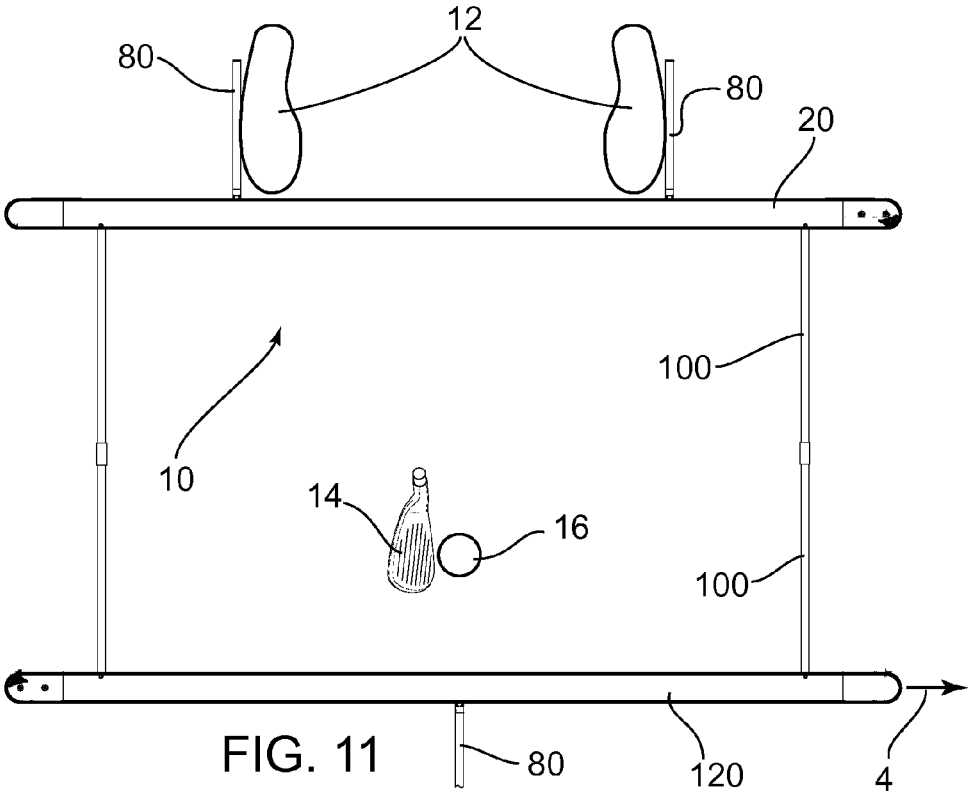
FIG. 11 is a perspective view of a golf swing training device in accordance with the present disclosure.

As depicted in FIG. 11, embodiments of the device 10 may comprise the second member 120 being configured to be positioned away from the first member 20 at both the target side and the rearward side, in a completely open position. In this way, the second member 120 may be configured to be positioned outside the trajectory of the golfer's intended swing. In other words, the ball 16 may be placed between the second member 120 and the first member 20, such that the second member 120 is outside the reach of the golf club 14. Golfers sometimes prefer a visual indicator beyond the golf ball 16 to assist the golfer 12 in making the proper golf swing. For example, to execute a straight golf shot, the golfer 12 may square his/her feet, hips, and shoulders with the first member 20 that is aligned in parallel with the target line between the ball 16 and the intended target. The golfer 12 may place his/her feet in parallel with the first member 20, as described herein, such that the golfer's toes touch the first member 20 and the outside of each of the golfer's feet touch the corresponding positioning members 80 set by the sliding mechanisms 50. The golfer 12 may also square the club face with the direction of the target line, or either of the first and second members 20 or 120. The golfer 12 may then swing the golf club 14 with a trajectory that results in the club face being square to the ball 16 and perpendicular with the target line at the point of impact between the club face and the golf ball 16. To assist in this objective, the second member 120 may also be positioned in parallel with the target line between the ball 16 and the intended target, with the second member 120 being outside the reach of the golf club 14 but within the golfer's vision, such that the second member 120 may be a visual indicator of the trajectory of the swing of the golf club 14 relative to the ball 16. In fact, with the second member 120 being parallel with the first member 20, the second member 120 is oriented along line 4 that is parallel with the target line. And, with the second member 120 positioned relatively close to the golf ball 16, but out of the reach of the golf club 14 during the golfer's swing, the second member 120 may function as a visual indicator for the golfer to reference to make a proper straight swing. In this way, the trajectory of the golf club 14 during the swing is the same as the direction indicated by the length of the second member 120, and the club face will be square to the ball 16 and perpendicular to the length of the second member 120 at the point of impact between the golf club face and the golf ball 16.

Embodiments of the device 10 include the device 10 being configured to function for both right-handed and left-handed golfers. Accordingly, the device 10 may be flipped over to accommodate both right-handed and left-handed golfers. The configurations of the device 10 described above are thus applicable to both sides of the device 10, top and bottom and left to right, as appropriate, to properly function for both right-handed and left-handed golfers. For example, indicators 82 may be positioned on the top side of the first member 20 and/or second member 120 and on the bottom side of the first member 20 and/or second member 120, such that the device functions properly for right-handed and left-handed golfers. Further, the indicators 82 may be positioned and oriented on the device 10 according to their intended use by either right-handed and/or left-handed golfers.

While this disclosure has been described in conjunction with the specific embodiments outlined above, it is evident that many alternatives, modifications and variations will be apparent to those skilled in the art. Accordingly, the preferred embodiments of the present disclosure as set forth above are intended to be illustrative, not limiting. Various changes may be made without departing from the spirit and scope of the present disclosure, as required by the following claims. The claims provide the scope of the coverage of the present disclosure and should not be limited to the specific examples provided herein.

What is claimed is:

1. A golf swing training device comprising:

a first member having a first end and a second end;

a second member having a first end and a second end;

an adjustable coupling arm functionally coupling the first member to the second member, wherein the coupling arm is configured to permit the first and second members to transition with respect to one another to increase or decrease a distance between at least a portion of first and second members; and a positioning member configured on each of the first member and the second member, the positioning members being configured to transition along a length of the first and second members, respectively, wherein at least one of the positioning members is configured to change length, wherein the positioning members are configured to pivot with respect to the corresponding first or second member between an orthogonal position, wherein the positioning member is orthogonal to the length of the corresponding first or second member, and a parallel position, wherein the positioning member is parallel to the length of the corresponding first or second member.

2. The device of claim 1, wherein the adjustable coupling arm further comprises two coupling arms, a first coupling arm pivotally coupled to the first member, a second coupling arm pivotally coupled to the second member, and the first and second coupling arms pivotally coupled to one another.

3. The device of claim 2, wherein the coupling arms are configured to permit the first end of the first member and the first end of the second member to transition away from one another while permitting the second end of the first member and the second end of the second member to remain proximate one another, and wherein the coupling arms are configured to permit the second end of the first member and the second end of the second member to transition away from one another while permitting the first end of the first member and the first end of the second member to remain proximate one another.

4. The device of claim 1, further comprising end caps configured to be inserted on each of the first and second ends of the first and second members.

5. A golf swing training device comprising:

a first member having a first end and a second end;

a second member having a first end and a second end;

an adjustable coupling arm functionally coupling the first member to the second member, wherein the coupling arm is configured to permit the first and second members to transition with respect to one another to increase or decrease a distance between at least a portion of first and second members; and a positioning member configured on each of the first member and the second member, the positioning members being configured to transition along a length of the first and second members, respectively, wherein at least one of the positioning members is configured to change length, and wherein two positioning members are configured on the first member and a third positioning member is configured on the second member, wherein each of the three positioning members are configured to pivot with respect to the respective first and second members, and the third positioning member is configured to change length.

6. A golf swing training device comprising:

a first member having a first end and a second end;

a second member having a first end and a second end;

an adjustable coupling arm functionally coupling the first member to the second member, wherein the coupling arm is configured to permit the first and second members to transition with respect to one another to increase or decrease a distance between at least a portion of first and second members; and a positioning member configured on each of the first member and the second member, the positioning members being configured to transition along a length of the first and second members, respectively, wherein at least one of the positioning members is configured to change length; wherein the end caps comprise a cable post about which a cable is looped on the first member, the cable running along the length of the first member in an interior opening thereof.

7. The device of claim 6, wherein two positioning members are configured on the first member, and wherein the two positioning members on the first member are coupled to opposing sides of the looped cable and configured to transition with respect to one another in opposite directions along the length of the first member based on the relative movement of one of the two positioning members with the cable.

* * * * *